US007212283B2

(12) United States Patent
Hother et al.

(10) Patent No.: US 7,212,283 B2
(45) Date of Patent: May 1, 2007

(54) IMAGING SENSOR OPTICAL SYSTEM

(75) Inventors: John Anthony Hother, Hove (GB); Robert Alexander Cockshott, Orpington (GB)

(73) Assignee: Proneta Limited, Brighton (GB)

( * ) Notice: Subject to any disclaimer, the term of this patent is extended or adjusted under 35 U.S.C. 154(b) by 431 days.

(21) Appl. No.: 10/763,735

(22) Filed: Jan. 22, 2004

(65) Prior Publication Data

US 2004/0211894 A1 Oct. 28, 2004

(30) Foreign Application Priority Data

Jan. 22, 2003 (GB) ..... 0301447.9

(51) Int. Cl.
*G01N 21/00* (2006.01)
*G01V 3/18* (2006.01)

(52) U.S. Cl. ..... 356/241.1; 250/269.1; 250/260; 250/258

(58) Field of Classification Search ..... 356/432–440, 356/241.1–241.3; 250/269.1, 260, 258, 269.3
See application file for complete search history.

(56) References Cited

U.S. PATENT DOCUMENTS 3,807,226 A * 4/1974 Williams ..... 374/4
5,652,617 A * 7/1997 Barbour ..... 348/85
5,717,209 A * 2/1998 Bigman et al. ..... 250/339.12
6,075,611 A * 6/2000 Dussan et al. ..... 356/432
6,472,660 B1 * 10/2002 Hother ..... 250/269.1

FOREIGN PATENT DOCUMENTS

GB 2 332 331 A 6/1999
JP 63167577 A 7/1988

* cited by examiner

*Primary Examiner*—Hoa Q. Pham
(74) *Attorney, Agent, or Firm*—Blakely, Sokoloff, Taylor & Zafman; Stephen M. De Klerk

(57) ABSTRACT

The present invention relates to an in-vessel or down-hole optical imaging sensor or system for operating in structures which may contain media with different spectral transmission characteristics. The imaging sensor of the present invention selectively emits and/or detects two or more independently controllable wavelengths or wavebands. The imaging sensor comprises an illuminator for emitting radiation of a specified wavelength or waveband through a medium to a target, at least one detector for detecting the radiation deflected by said target and at least one amplifier for providing non-linear amplification of the detector output.

25 Claims, 9 Drawing Sheets

IMAGING SENSOR OPTICAL SYSTEM

CROSS-REFERENCE TO RELATED APPLICATIONS

The present patent application claims priority from Great Britain Patent Application No. 0301447.9, filed on Jan. 22, 2003.

BACKGROUND OF THE INVENTION

1). Field of the Invention

The present invention relates to an optical system image sensor operating in structures which may contain media with different spectral transmission characteristics; for example, in vessels containing both crude oil and water, either by rendering all media transparent simultaneously, or, on command, by rendering one or more of the media opaque to allow its detection.

2). Discussion of Related Art

In the oil industry, amongst others, it is necessary to inspect surfaces for cracks, corrosion, scale or other defects or characteristics, to examine welds to establish the integrity of a structure and ascertain the need for repair or replacement. It is desirable to use a single sensor to inspect internal surfaces of structures such as tanks, wells and pipelines containing crude oil and water, and also distinguish between oil and water, without emptying, flushing or cleaning the structure. It is also desirable to inspect surfaces coated with oil or wax in air.

Image sensors operating in structures containing fluids transparent in the visible region of the electromagnetic spectrum such as water are well-known, and disclosed, for example, in EP0846840, EP0264511, and WO0206631.

Operation may be extended to opaque fluids by flushing the vessel with a transparent fluid in the vicinity of the image sensor, and a method for doing this is disclosed in U.S. Pat. No. 4,238,158.

An image sensor operating directly in fluids which are opaque in the visible region of the spectrum but transmit energy at other wavelengths, for example, crude oil, is disclosed in GB2332331B. Transmission in these fluids may be limited, restricting operation of a practical sensor to close range.

The absorption at a given wavelength varies widely for different crude oils, but the general shape of each plot of absorption against wavelength is very similar and transmission "windows" occur at the same wavelengths in the spectrum, as shown in U.S. Pat. No. 5,266,800 which discloses a method for using infrared absorption measurements to discriminate between different crude oils.

As well as discriminating between crude oils, is also possible to distinguish between other fluids by measuring their spectral absorption characteristics, as disclosed in U.S. Pat. No. 4,994,671.

It is an object of the present invention to enable an image sensor to operate within, and also by remote command or autonomous internal control to discriminate between, media such as crude oil and water, which have transmission bands in different regions of the spectrum.

SUMMARY OF THE INVENTION

The invention, in one aspect, provides an in-vessel or down-hole imaging sensor comprising means adapted to selectively emit and/or detect two or more independently controllable wavelengths or wavebands.

The independently controllable wavelengths or wavebands render the media in the field of view opaque or transparent, or reveal the presence of one or more medium or component in the media by some other means such as exciting fluorescence.

In accordance with another aspect, the invention provides a method of obtaining images in a vessel, comprising operating a sensor and illuminating means to selectively emit and/or detect radiation of two or more independently controllable wavelengths or wavebands.

It is also an object of the present invention to provide uniform illumination and maximum illumination power on targets in the surrounding media close to, or in contact with, the image sensor window, to allow imaging at close range (e.g., from 0 to 25 mm) in media with limited transmission. This is provided by a further aspect of the invention, which provides an in-vessel or down-hole imaging sensor comprising a sensor window; illuminating means for emitting radiation; optical means for directing said radiation through an area of said sensor window in a first direction and optical means for receiving radiation reflected from a target illuminated by radiation from said illuminating means through the same area of the said sensor window in a second direction. Thus a target in contact with the image sensor window will be illuminated by the outgoing radiation.

The image sensor preferably comprises an imaging detector and associated electronics and mechanical housing, an illuminator and, optionally, a common-path optic which forms the window for both the outgoing and incoming radiation.

In the preferred embodiment of the invention, the detector comprises a vacuum tube device sensitive to visible and near infrared radiation, but may also comprise other detectors such as charge couple devices, active pixel sensors, thermoelectric sensors, bolometric sensors or InGaAs devices, either as two-dimensional arrays, or linear array sensor or single point detectors with a scanning device.

In a further embodiment of the invention, a thermoelectric cooler may be used to stabilize or lower the temperature of the detector, and the heat pumped from it is conducted through the housing into the surrounding fluid. Other coolers may be used, including, but not limited to, Joule-Thomson or Stirling coolers. Alternatively, energy can be absorbed into a medium within the housing which heats up or changes phase. Cooling or temperature control allows the invention to be used in media at temperatures higher than the desired or maximum operating temperature of the detector, detectors or other components. For example, the cooler or coolers may be used to control, reduce or eliminate the dark signal generated in the detector or detectors, and to control, reduce or stabilise other temperature dependant effects in the detector or electronics.

In the preferred embodiment of the invention, incoming energy is focused onto the detector using optics which can incorporate anti-reflection coatings optimised either for the full spectral range of incoming radiation, or for the discrete wavelengths or wavebands emitted by the illuminators or transmitted by the media in which the image sensor will be operated.

In an alternative embodiment of the invention, optics designed for use in the visible spectrum but still providing adequate performance in the spectral range used by the image sensor may be employed.

In the preferred embodiment of the invention the optics map the scene onto the detector using a tan theta function, but other techniques such as a tele-centric system may be employed.

In a further embodiment of the invention, fiducial marks may be incorporated in the images to assist the use of the images for metrology. The optical system may place the fiducial marks in the scene viewed by the detector, or the marks may be added electronically to the output signal.

In the preferred embodiment of the invention, the illuminator comprises sources selected to match the spectral transmission of the media in which the image sensor will be used, which may be laser diodes, for example, in the 1500–1650 nm waveband for crude oil and in the visible-1350 nm waveband for water. When both types of source are illuminated imaging is possible in both oil and water simultaneously. When only the source in the 1500–1650 nm band is energised imaging in crude oil is possible but water will appear black, as it absorbs strongly in this waveband, and the converse is true when only the source emitting in the visible-1350 nm band is energised. Alternatively, a broadband source such as an incandescent filament lamp, discharge (including flash) lamp, Light Emitting Diode or an electro-luminescent device could be used together with filters to select the appropriate wavebands, or a combination of broad and narrow band sources, with or without filters, could be used. By this means imaging is possible in both crude oil and water, and, by energising only one of the two types of illumination, the presence of either fluid may be detected as globules, layers, or separate slugs, in multiphase flow, in tanks, wells, or pipelines.

In an alternative embodiment of the invention, a broadband source and detector or detectors together with mechanically interchanged filters, or filters whose transmission wavelength or waveband can be altered electrically, may be used.

In an alternative embodiment of the invention, a mosaic of wavelength selecting filters are applied to individual pixels in an array or line detector, and images in each medium obtained by appropriate electronic processing of the output signals. For example, this is done in conventional single-sensor colour cameras operating in the visible region of the spectrum, where a red filter is placed over every third pixel in each line on the sensor, a green filter over each neighbouring pixel, and a blue filter over the remaining pixels. Clearly this technique can be applied to an arbitrary number of wavebands some or all of which can be outside the visible region of the spectrum.

In an alternative embodiment of the invention, some or all of the wavelengths or wavebands required are produced by the illuminator, and radiation returning from the target is focused onto a slit. Radiation passing through the slit is then dispersed using, for example, a prism or prisms or a diffraction grating, operate in either transmission or in reflection. The dispersed spectrum is then imaged onto multiple discrete detectors or a detector array or arrays, and wavelength selection is performed by selecting the appropriate discrete detector or location within a detector array. In this embodiment, spectral information is provided in one axis and spatial information is provided in the other, and two-dimension spatial images may be formed by scanning the incoming radiation over the slit.

In an alternative embodiment of the invention, illumination is provided in all the required wavebands, and a separate detector is provided for the waveband transmitted by each medium, the incoming radiation being separated into the appropriate wavebands by a beam-splitter or beam splitters and directed to each detector by relay optics. A single focusing lens may be used, which does not have to bring all wavelengths to a focus on the same plane as the detectors may be placed at different distances from the target, or separate focusing lenses optimised for each waveband may be used. Detectors optimised for each waveband may also be used, and may provide colour or monochrome outputs. In the oil and water example, a monochrome infrared sensor may be used for the oil transmission band, and a colour detector may be used in the visible region of the spectrum in water. This arrangement provides separate images in each medium simultaneously from one instrument. Each medium can be detected by comparing the images. In a further embodiment of this technique, images are combined electronically or by other means to form composite images, and individual media can be revealed by subtracting images or by adding false colour.

In an alternative embodiment of the invention, more than one assembly comprising relay and focusing optics and detector or detectors is provided to enable stereoscopic images to be obtained.

Optionally, polarizing filters may be included in the optical system.

Oil and water are discussed in the example above, but by incorporating appropriate illumination further embodiments of the invention can be applied to different media and also to more than two media. The media may be, e.g., gases or vapours.

It may not be possible to select illumination wavelengths such that the absorption in the various media in which the image sensor operates is identical. For example, with the preferred embodiment of the invention, the absorption in crude oil in the 1500–1650 nm band is typically much higher than the absorption in water in the visible to 1350 nm band. In order to stay within the dynamic range of the detector, the output power for each emitted waveband is matched to characteristics of the medium it penetrates, allowing the image sensor to operate continuously while passing through different media. In the oil and water example, lower output power is needed in the water band than in the oil band. When the image sensor operates in media with different absorption characteristics, the illumination level at each wavelength or waveband can only be exactly equal at one distance from the image sensor. In the more strongly absorbing medium, objects closer than this distance will appear brighter, and objects further away will appear fainter, than in the more weakly absorbing medium.

In order to mitigate the consequences of this effect, a further aspect of the invention provides a down-hole or in-vessel imaging apparatus comprising illuminating means for emitting radiation of a specified wavelength or waveband through a medium to a target; detector means for detecting radiation deflected by said target; and amplifier means for providing non-linear amplification of the detector means output.

The preferred embodiment of the invention incorporates a video amplifier with a non-linear response to compress the dynamic range in the analogue output signal. Since the non-linear absorption effects described above are generally believed to be exponential, or approximately exponential, this could be counteracted, in one example using a logarithmic or approximately logarithmic response. If the absorption effect is not exponential, then an appropriate amplifier response could be selected to counteract the effect. This enhances the pictures and makes video and still images easier to interpret when using display systems with lower dynamic range than the detector, and reduces the number of bits needed to digitise the output. Non-linear functions may also be applied by digital processing after digitising the analogue output. Optionally, different functions may be selected to suit the medium in which the sensor is operating, for example, a linear response could be selected in water and a logarithmic response in oil. The commands used to select the illumination source could also be also to select the response functions, or separate command could be used.

This apparatus may find application in different types of imaging systems where the medium surrounding the target has a non-linear illumination absorption effect.

Preferably, however, this arrangement is used with a selectable wavelength or waveband system as previously described. Different amplifiers may be provided for the different wavelengths or wavebands for different media, with means for selecting between the amplifiers. Alternatively, a single amplifier may be provided with selectable characteristics.

In the preferred embodiment of the invention, the non-linear function applied to output signal can be varied, as appropriate to the particular application, for example by adjusting the slope of a logarithmic amplifier. This may be adjusted by remote control. A remote control command may be provided by superimposing control signals on the video output signal.

In another embodiment of the invention, the illumination power is controlled automatically using a signal derived from the output from the detector to ensure that energy received from the scene lies within the dynamic range of the detector.

In the preferred embodiment of the invention, illumination is provided by a single laser diode or an array of laser diodes assembled into a module or modules installed within the image sensor housing and incorporating the mechanical mounting and electrical connections to each diode. Separate electrical connections are provided to diodes or groups of diodes emitting at different wavelengths. In an alternative embodiment of the invention, the emitting device or devices are also thermally coupled to a heat sink such as the image sensor housing using a high conductivity link or heat pipe, optionally incorporating a thermo-electric or other cooler such as a Joule-Thomson or Stirling device to control, stabilize or lower the temperature of the emitting devices. Alternatively, energy can be absorbed into a medium within the housing which heats up or changes phase. When cooling or temperature control is provided, the illumination system may be operated when the housing is immersed in media at temperatures above the desired or maximum operating temperature of components used to provide the illumination. For example, the cooler or coolers may be used to control, stabilise or increase the output from the emitting devices and to control, reduce or stabilize other temperature dependant effects. For example, the cooling system may be used to increase the output from laser diodes, the output from which reduces as the temperature increases.

In an alternative embodiment of the invention, illumination is provided by collimated laser beams scanned over the target using known techniques such as rotating mirrors.

In an alternative embodiment of the invention, illumination is provided by a broad-band source or sources such as an incandescent filament lamp or lamps or by a discharge lamp or lamps and, optionally, selectable optical filters are used to provide wavelength switching.

In an alternative embodiment of the invention, illumination is provided by more than one independently-controllable broad-band source, each with its own wavelength restricting filter or filters.

The filters may be moveable or may be fixed with independently moveable shutters to select the desired wavelengths or wavebands.

In the preferred embodiment of the invention, cylindrical spheric or aspheric lenses in front an array of laser diodes or other single or multiple discrete sources direct radiation into the common-path optic. Optionally, lenslet arrays may be used. Optionally, a diffuser may be placed in the optical path of the illumination system. This arrangement provides uniform illumination of the scene viewed by the image sensor. The envelope of the beam projected into the surrounding media may be matched to the field of view of the image sensor at the desired operating distance, or a collimated beam may be used. Optionally, the illumination may be polarized, for example when operating with targets or media sensitive to polarisation.

In the preferred embodiment the common-path optic also forms the image sensor window and must withstand the ambient pressure in media in which the image sensor is immersed. The common-path optic transmits the out-going illumination radiation and the returning radiation from the scene through the same window area in contact with the surrounding media. In the preferred embodiment of the invention, the refractive index of the common path optic is chosen to match that of the media in which the image sensor operates in order to avoid reflections at the window. In an alternative embodiment, reflections are controlled using anti-reflection coatings matched to the wavebands emitted by the illuminator and the refractive indices of the media in which the image sensor will operate.

In an alternative embodiment, the common-path optic may comprise an assembly of more than one component, including, for example, solid components coupled by appropriate means such as optical cement or a fluid or fluids which may be chosen such that the refractive indices match, or which may incorporate anti-reflection coatings.

The common-path optic can also provide optical power, for example to form all or part of the image sensor focussing optics, the illuminator beam shaping optics and to correct distortion in the optical system. The common-path optic can be configured in various ways to do this, for example by shaping external surfaces, incorporating other refracting or reflecting optical components, incorporating diffractive elements or graded index elements, or a combination of some or all of these techniques.

In an alternative embodiment of the invention, the illumination system is external to the image sensor casing. This arrangement may be used when the refractive indices of the surrounding media are significantly different; for example, when viewing in air objects coated in oil or wax. In this situation the invention will show the visible surface, and, on command, render the oil or wax transparent to reveal the underlying surface of the object.

One embodiment of the image sensor is supplied from a single electrical supply, and incorporates power conditioning for the laser diode array and detector, an analogue video output, and control electronics to adjust independently the power output of two or more laser diodes or groups of diodes. The output power control is commanded by signals applied to the video output line, decoded within the image sensor. In a further embodiment of the image sensor, signals applied to the video line are also used to adjust the characteristics of the non-linear amplifier.

A further embodiment of the invention incorporates internal digitisation and compression of the output signal, and a digital output, with separate command lines.

Further embodiments of the invention can incorporate some or all of the following features: power from internal batteries, internal data storage, and pre-programmed, automatic switching between the different wavelengths. If some or all of these features are incorporated, the resulting embodiment of the image sensor can be deployed remotely to acquire images autonomously without the need for external connections, with the internally-stored data being downloaded on retrieval of the sensor.

In one embodiment of the invention, the image sensor is arranged in a cylindrical geometry with a sideways-looking optical system. This configuration is suited to imaging the inner walls of pipes, and may be deployed horizontally, for example on a pig or crawler, or vertically, for example on a wireline. In a further embodiment, the side view window is curved to match the cylindrical profile of the sensor housing, and, when operating in media which do not match the refractive index of the window, compensating optics can be included to counteract the cylindrical-lens effect of the curved outer face.

A similar arrangement, but with a rectangular rather than a cylindrical housing, is suited to inspecting the inner walls of tanks.

In another embodiment the image sensor is arranged with the window at the end of the housing. This geometry is suited to inspecting the bottom surface of tanks or obstructions in pipes.

Other geometries may be employed in embodiments of the invention tailored to other applications, including, but not limited to, examples such as welds joining right-angle plates.

All the embodiments described above may be deployed in various ways, examples of which include wirelines, arms, crawlers, or remotely operated vehicles.

BRIEF DESCRIPTION OF THE DRAWINGS

Preferred embodiments will now be described, by way of example only, with reference to the drawings.

DESCRIPTION OF THE PREFERRED EMBODIMENTS

Figure 1:
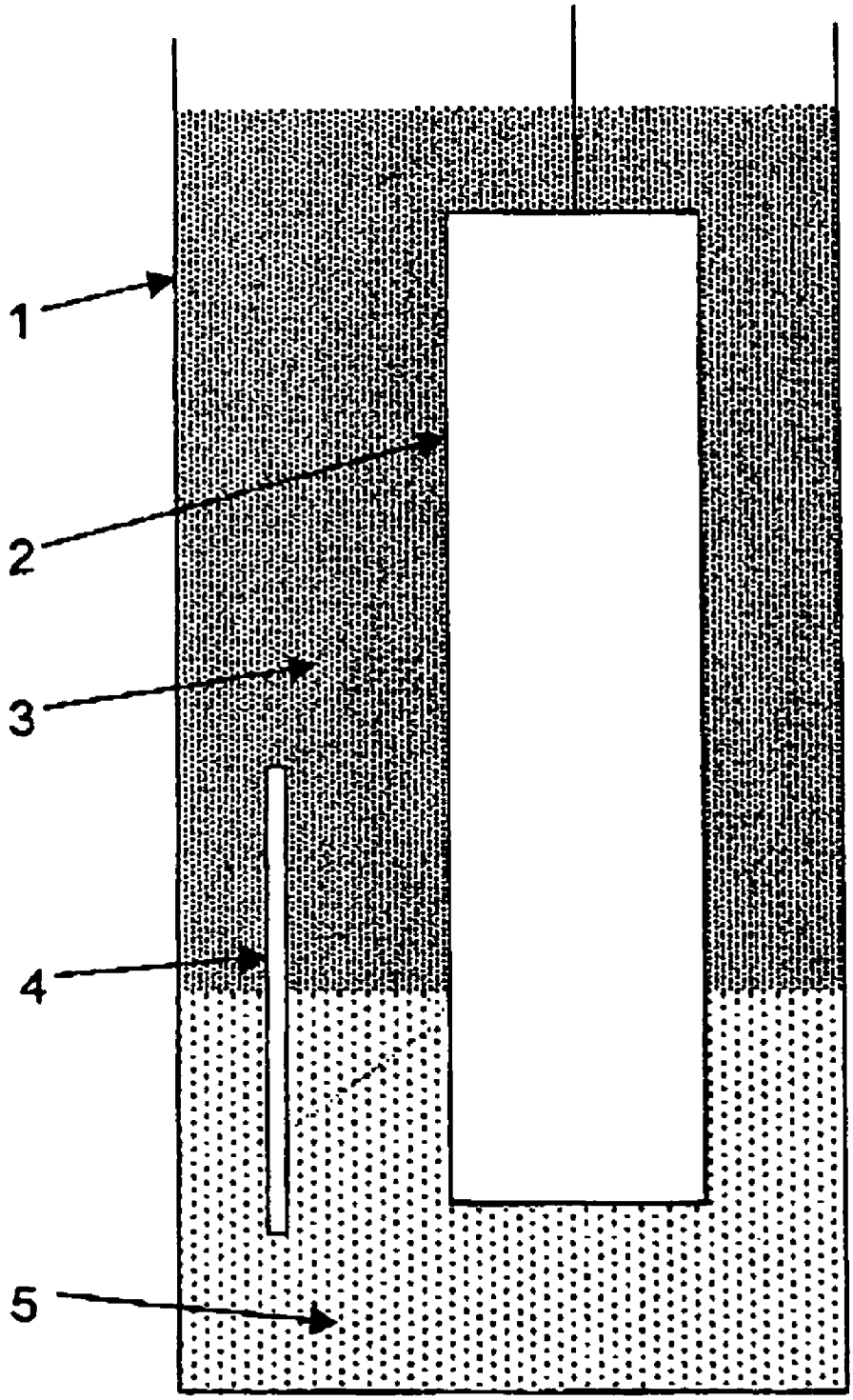
FIG. 1 shows a schematic view of one embodiment of a sensor according to the present invention.

FIG. 1 shows a schematic diagram of a structure 1 in which a sideways-looking embodiment of the image sensor 2 is immersed in medium 3 and medium 5. The target 4 is viewed by the image sensor while straddling the boundary between the two media. The figure shows the image sensor deployed in the vertical axis, but, with an appropriate delivery mechanism, it may be deployed in any orientation.

To view and image the target 4, the image sensor 2 emits radiation at wavelengths which are transmitted by each media 3 and 5. For example, if medium 5 is crude oil, and medium 3 is water, the sensor will emit radiation in the 1500–1650 nm waveband, and also in the visible-1350 nm waveband. This may be achieved in various ways. For example, sensor 2 may comprise light emitting or laser diodes, or groups of diodes, which operate in the respective wavebands and, for simultaneous imaging in both media, both diodes or groups of diodes will be operated as illumination sources. Alternatively, sensor 2 could emit radiation covering the visible-1650 nm waveband which would then be split, by a beam-splitter (not shown). Of course, for different media, different wavelengths or wavebands would be used.

Figure 4:
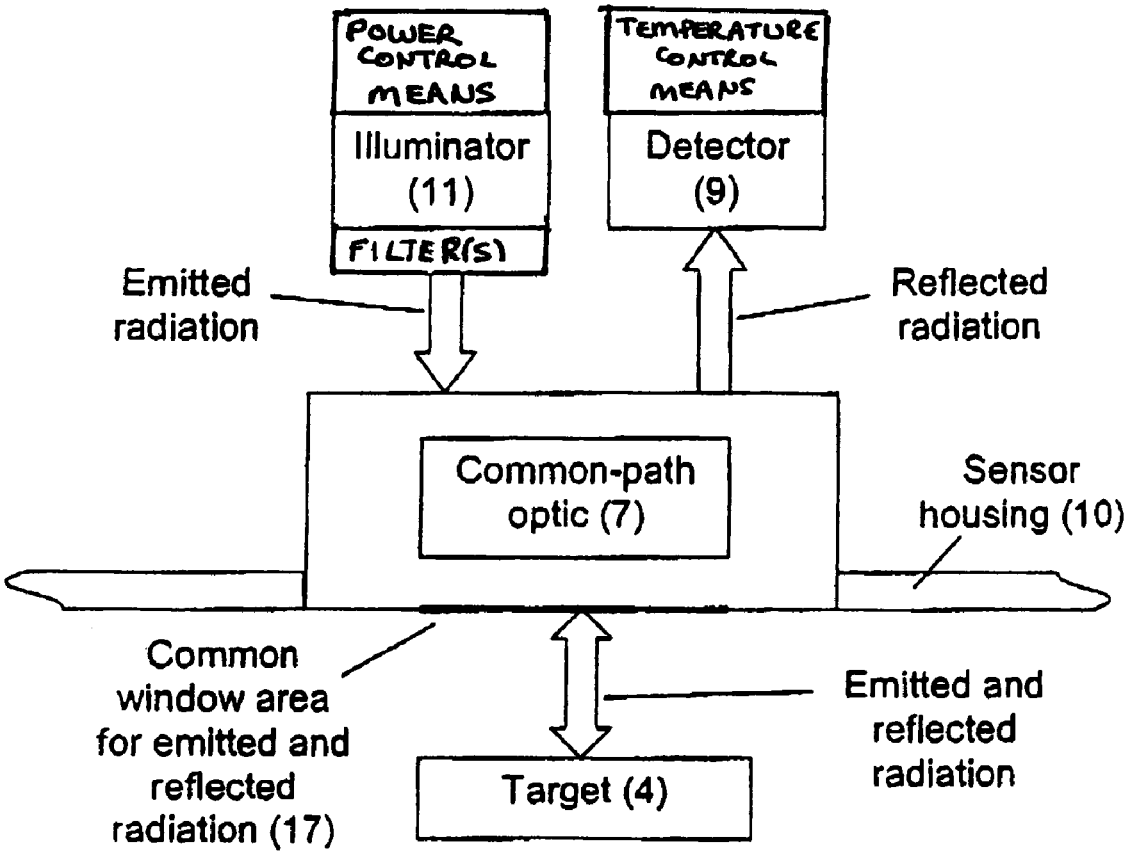
FIG. 4 shows a block diagram showing the common-path optic principle of an embodiment of the invention.
Figure 5:
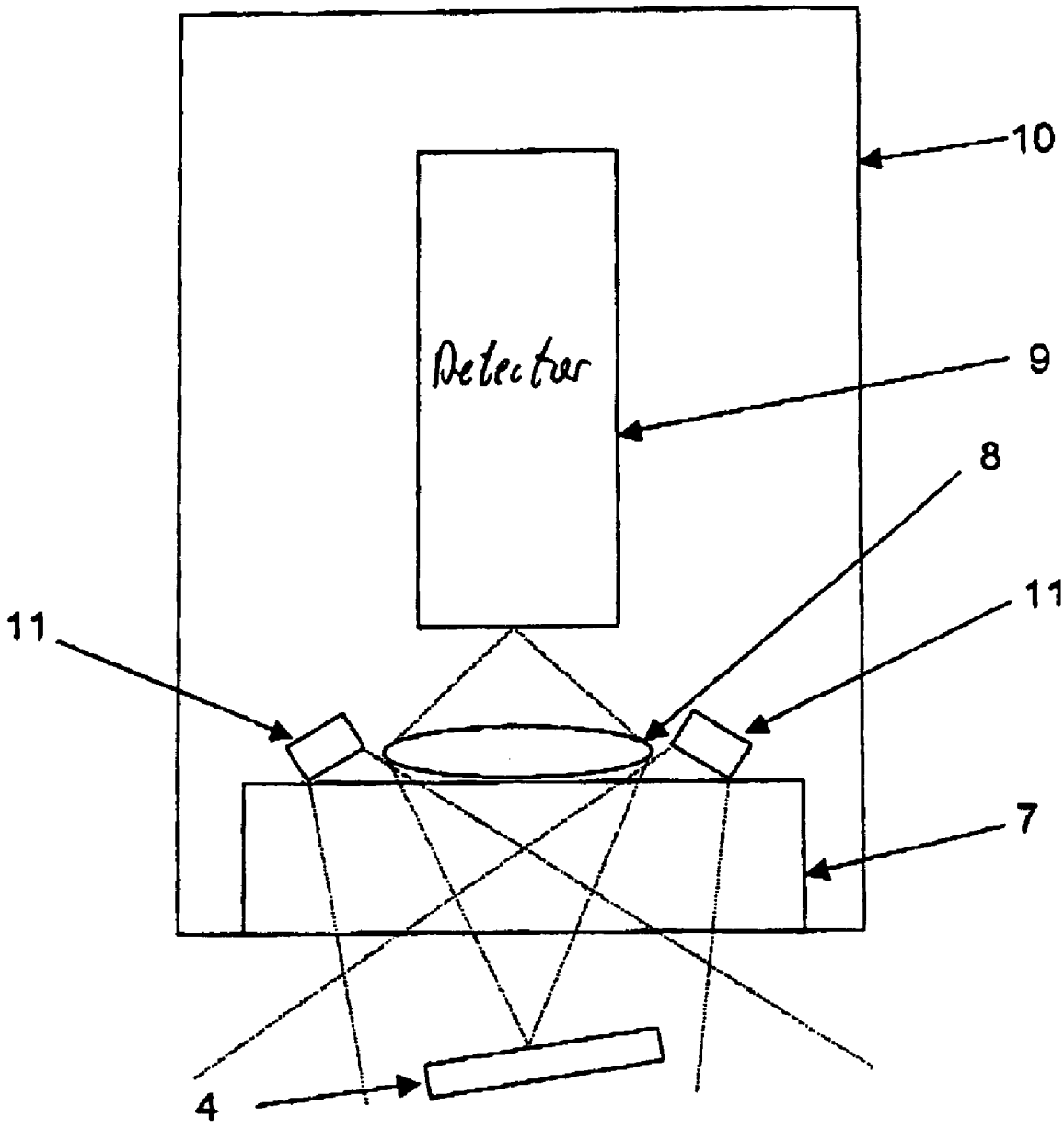
FIG. 5 shows a schematic view of an optical system used in a sensor according to the invention.
Figure 6:
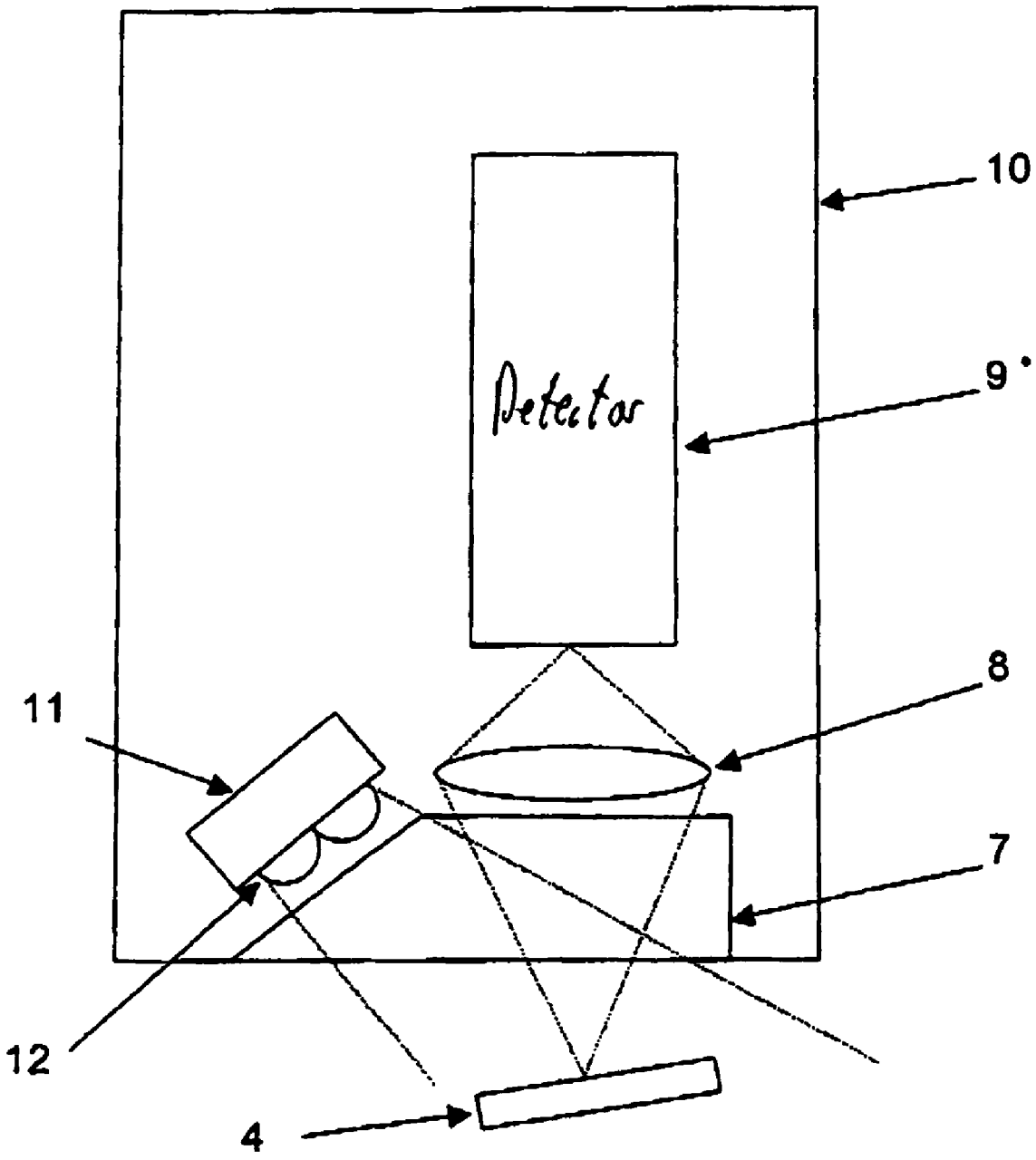
FIG. 6 shows another embodiment of an optical system used in a sensor according to the invention.

The illumination radiation is preferably directed through a sensor window, as described in more detail in relation to FIGS. 4 to 6.

The radiation is, because of its selected wavelengths, transmitted through both media 3 and 5 and strikes the target 4. The reflected radiation is focused onto the detector by optics 8, and an image of the target can then be derived using any of various known imaging techniques including the use of two dimensional photo-sensitive arrays such as charge coupled devices, or vacuum tube devices, or line or single point sensors together with scanning mechanisms, and appropriate electronic readouts.

Preferably the radiation reflected by the target is directed through the same sensor window as the emitted radiation (as discussed further below) and processed by the imaging sensor to form an image of the target.

Figure 2:
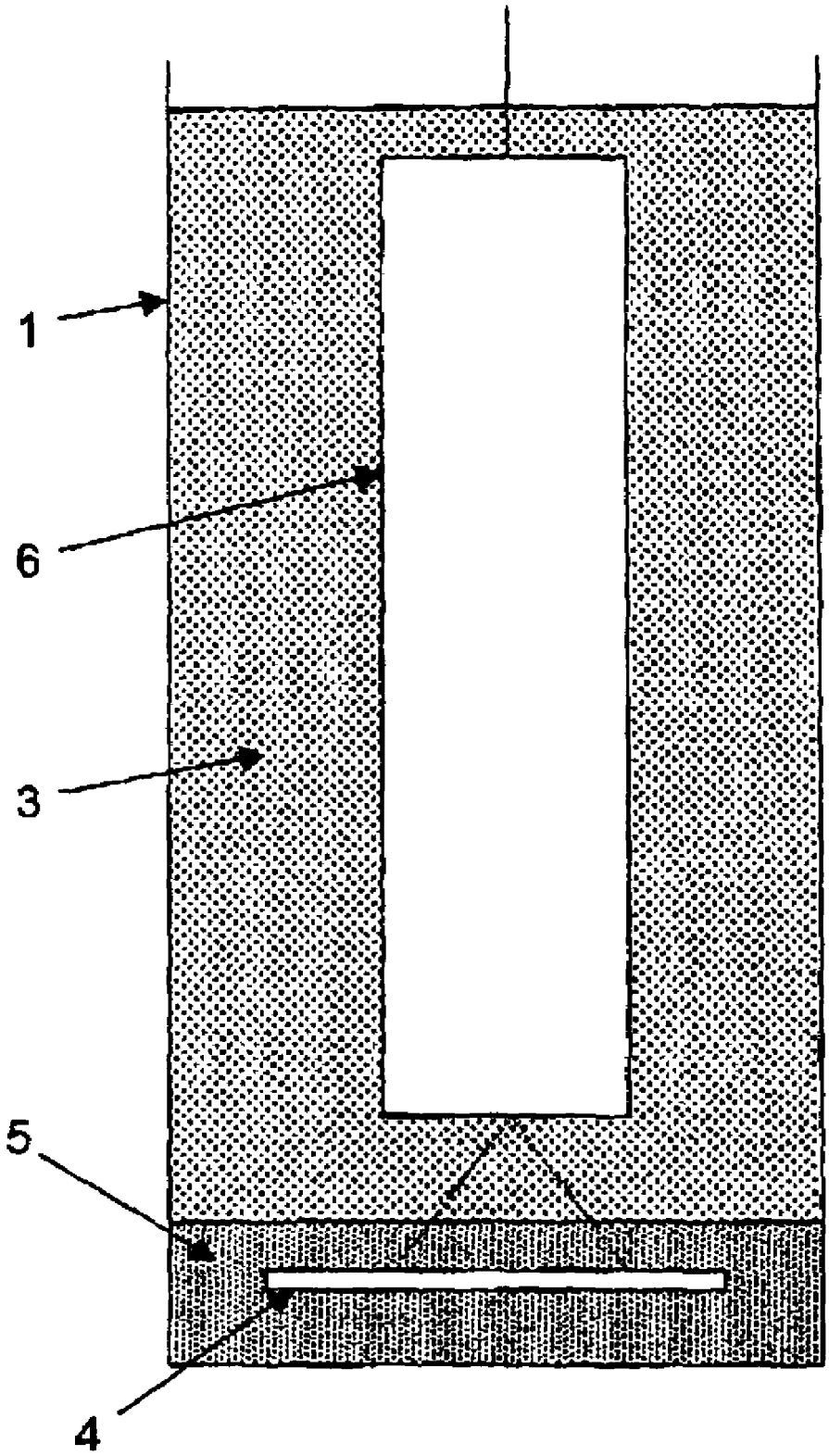
FIG. 2 shows a schematic view of a further embodiment of a sensor according to the present invention.

FIG. 2 shows a schematic diagram of a structure 1 containing an end-viewing embodiment of the image sensor 6. As with the sideways-looking embodiment, this configuration can be deployed in any orientation.

The image sensor is immersed in medium 3, while the target 4 is immersed in medium 5. The sensor 6 can be arranged to emit radiation which is transmitted by medium 3. If medium 5 is also transparent to some or all of this radiation, the target can be illuminated. If the spectral transmission "windows" in medium 3 and medium 5 partly overlap, medium 5 can be made either transparent or opaque while the sensor is in medium 3 by selecting the wavelength of the emitted radiation. If there is no overlap between the spectral transmission "windows" in media 3 and 5, medium 5 will be detected as a dark region in front of the sensor but the target cannot be illuminated. Medium 5 will remain opaque until the sensor passes through medium 3 and into medium 5. Once in medium 5, illumination with an appropriate wavelength or waveband can be emitted and the target 4 will be visible.

Switching between the different wavebands or wavelengths could be done automatically by switches operating according to a pre-programmed sequence.

Figure 3:
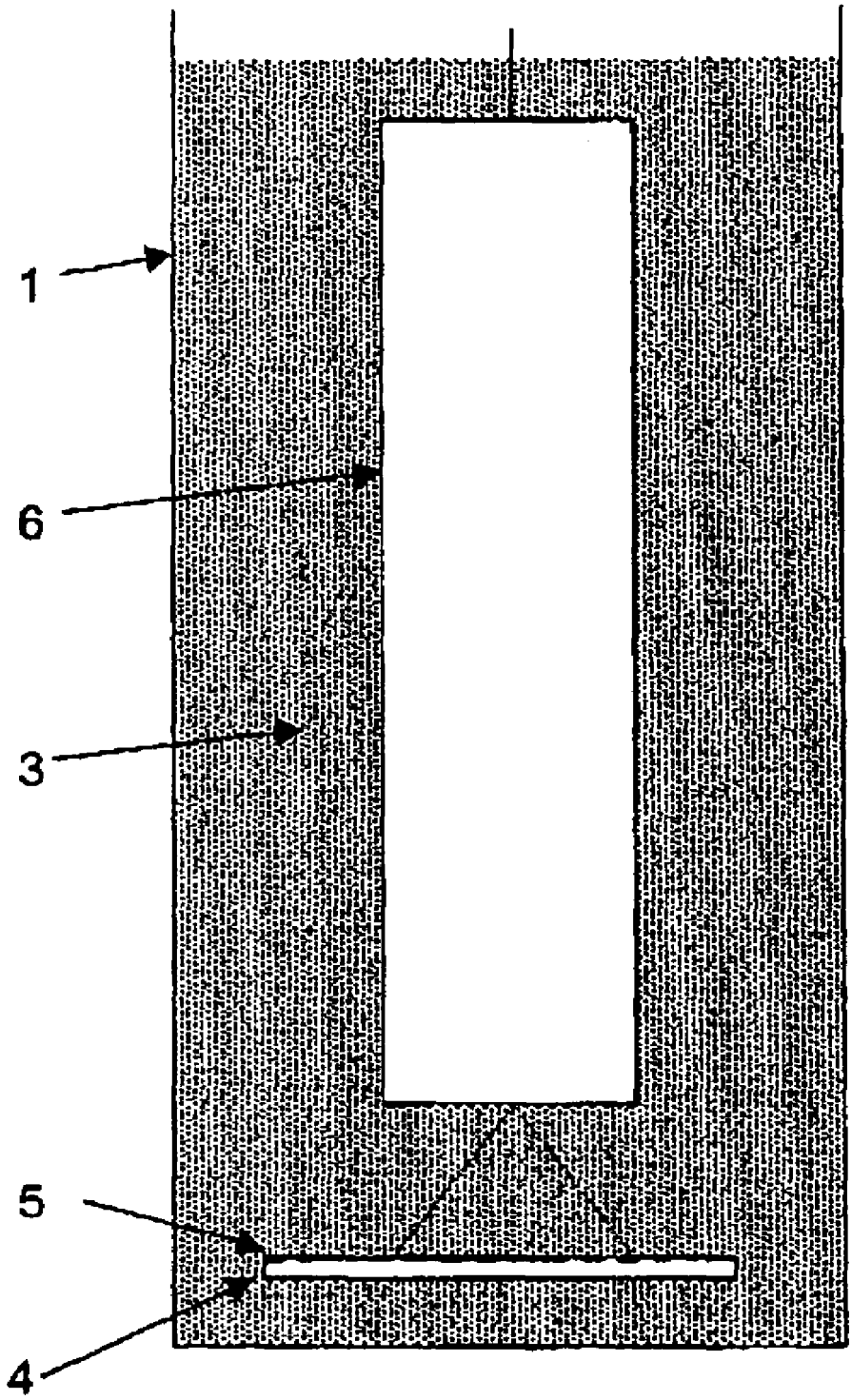
FIG. 3 shows a schematic view of a yet further embodiment of a sensor according to the present invention.

FIG. 3 shows a schematic diagram of a structure 1 containing an end-viewing embodiment of the image sensor 6. The image sensor and the target 4 are immersed in medium 3, and the target is coated in medium 5. As with the sideways-looking embodiment, this configuration can be deployed in any orientation.

Here, the sensor 2 could be arranged to emit radiation in a waveband which is transmitted by medium 3, but not by medium 5, to give an image of the coated object target 4. Further, on command, the sensor could emit radiation which is transmitted by medium 5, to reveal the underlying surface of the coated object. The types of illumination source and image processing are as described above in relation to FIG.

1. Switching between the different wavebands or wavelengths could be done automatically by switches operating according to a pre-programmed sequence.

FIG. 4 shows a block diagram illustrating the principle of the common-path optic. Radiation, at the selected wavelength(s), is emitted by the illumination source(s) 11 of the imaging sensor. This radiation is directed by a so-called common-path optic 7 (described in more detail in relation to FIGS. 4, 5 and 6) to exit through a sensor window. The emitted radiation strikes the target 4 in the vicinity of the window and radiation reflected by the target is directed through the same area 17 on the same window through which the illumination radiation passes. The common-path optic 7 then transmits the reflected radiation to focusing optics 8 which form an image of the target on the detector(s) 9 of the imaging sensor.

Figure 7:
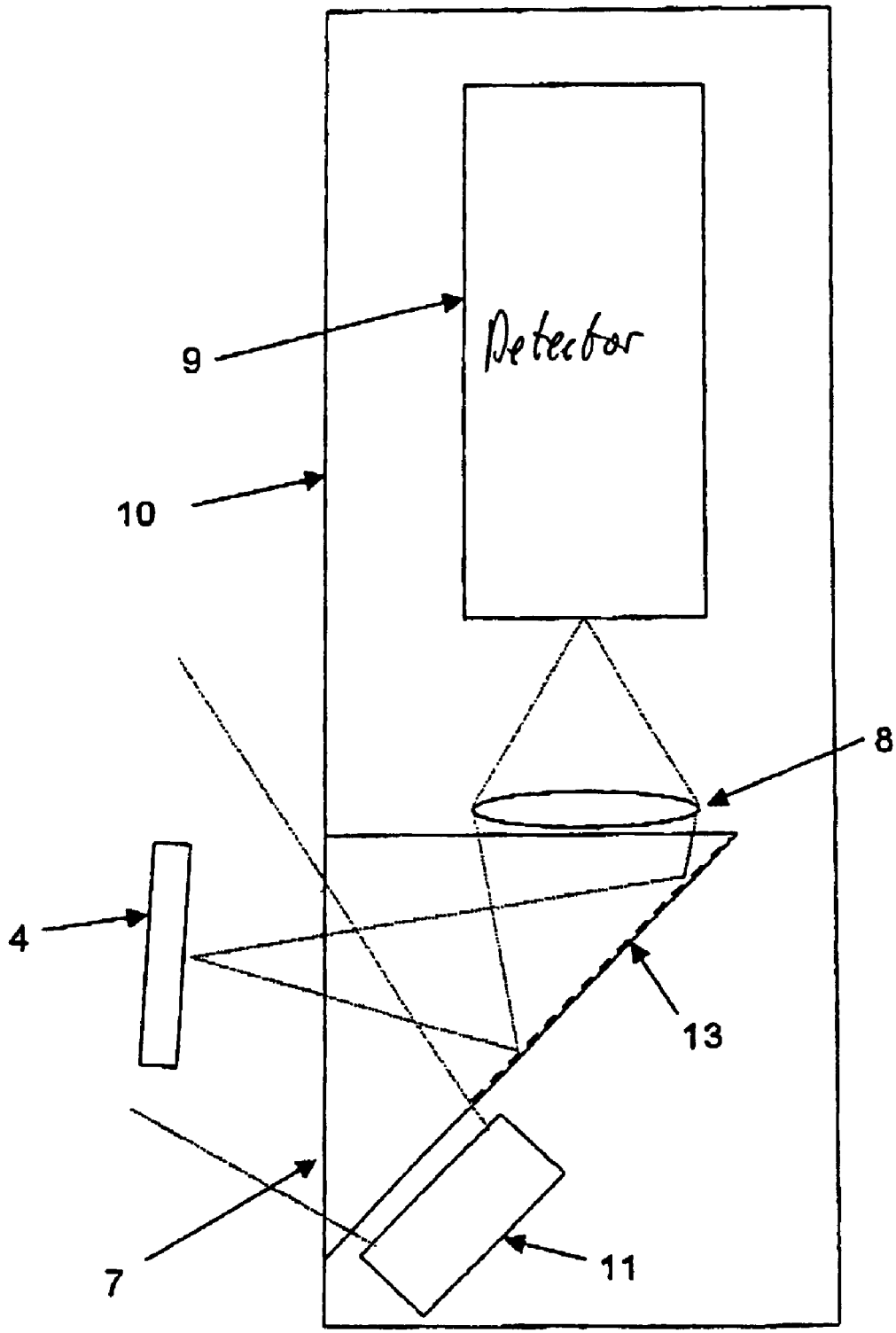
FIG. 7 shows another embodiment of an optical system used in a sensor according to the invention.

As discussed above, this common-path optic allows imaging at close range in media with limited transmission. The target is still illuminated even when in contact with the window, an improvement on the arrangement illustrated in FIG. 3, where the sensor window and illuminators are separated by a finite distance. FIGS. 5 to 7 below show examples of practical implementations of the common-path optic.

FIG. 5 shows a schematic diagram of the optical system for an example embodiment of the invention, in this case an end-viewing image sensor. The common-path optic 7 is sealed into the image sensor housing 10 and forms the window for the illumination system and the detector. The output from illuminators 11, which may incorporate beam shaping or collimating optics, is directed into the common-path optic. Radiation reflected back from the target 4 passes through the common-path optic to the lens 8 which focuses the scene onto the detector 9. In this example two illuminators are shown, but any number from one to a continuous ring of units, or a single ring-shaped unit, around the detector lens 8 may be used.

FIG. 6 shows a schematic diagram of the common-path optic in an alternative embodiment of an end-viewing geometry. The common-path optic 7 is sealed into housing 10, which contains the detector 9, detector focusing optics 8 and the illuminator 11 and illuminator beam shaping optics 12. Target 4 is illuminated by, and viewed by, the image sensor.

FIG. 7 shows a schematic diagram of the common-path optic for the sideways-looking embodiment of the image sensor. The common-path optic 7 is also sealed into the housing 10, and forms the window for the illuminator 11 and the detector. Radiation from the illuminator passes through the common-path optic to the target 4. Returning radiation passes back into the common-path optic 7 and is reflected by the coating 13 into the lens 8 and focused onto the detector 9. In a further embodiment of this configuration the external surface of the common-optic may be curved in one direction to match a cylindrical housing, to facilitate operation in a cylindrical vessel.

Figure 8:
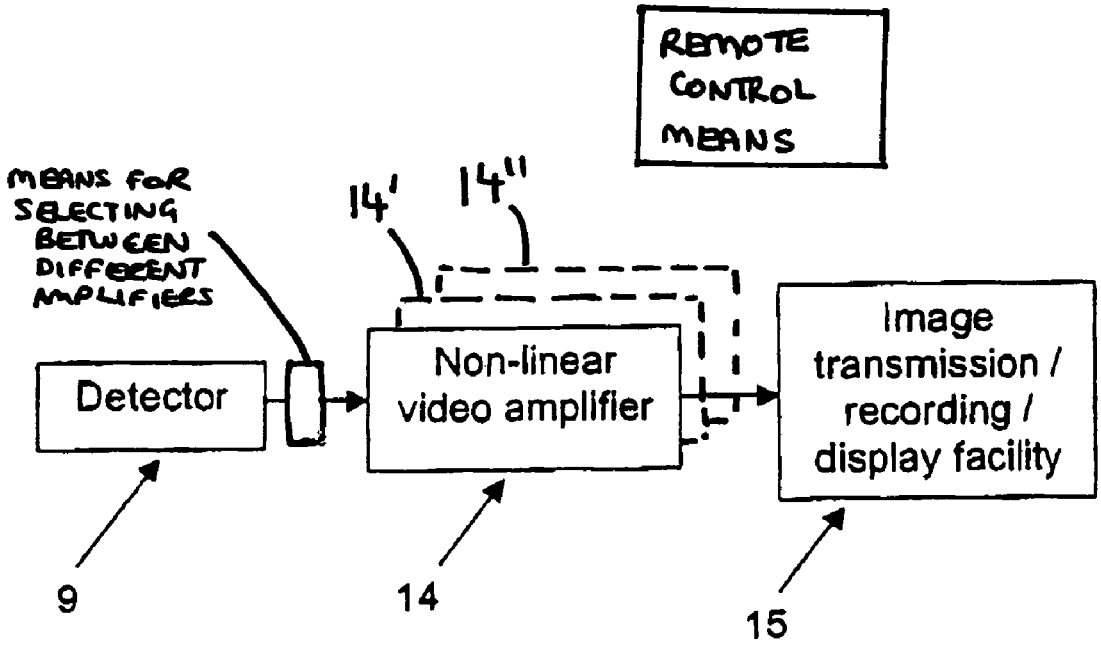
FIG. 8 shows an electrical block diagram of an image sensor processing stage.

FIG. 8 shows an electrical block diagram for an example embodiment of the image processing components of the sensor. Since, where objects are viewed in different media, different rates of absorption exist, the illuminatioh levels at each wavelength or waveband are different. So as to mitigate the effects of this, a video amplifier 14 and other amplifiers 14' and 14" with a non-linear response may be connected to the detector 9 to compress the dynamic range in the output signal. For example, a logarithmic response may be applied. The response characteristics of the amplifier are preferably adjustable; for example, the slope would be adjustable if a logarithmic response were applied. The resulting processed image can then be further transmitted, recorded and/or displayed. The non-linear amplifier may be integral with the image sensor, or may be located in a separate unit outside the image sensor housing.

Figure 9:
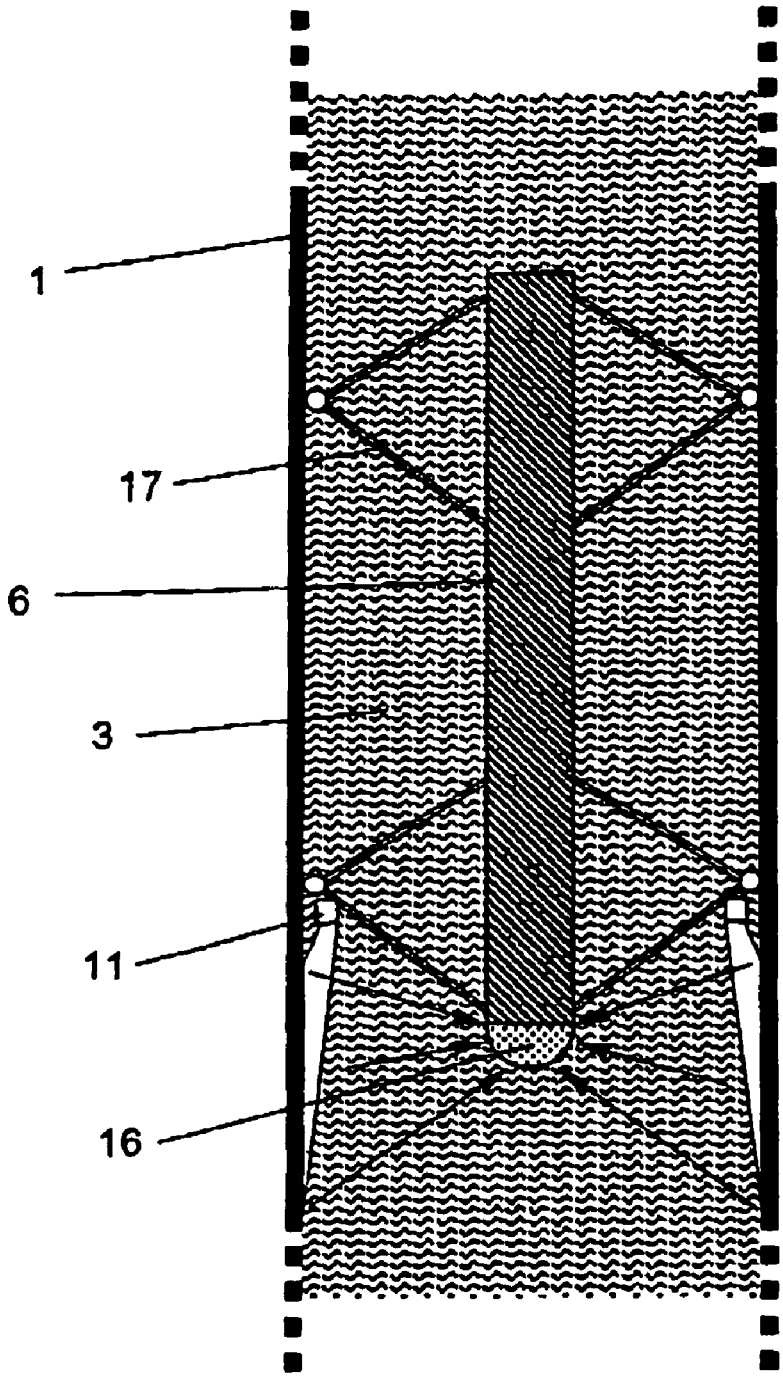
Figure 9 (Prior Art)
FIG. 9 shows a sensor without a common path optic operating in a single medium opaque to visible radiation, as disclosed in GB2332331B, in which the present invention may find application.

One application for the present invention is in a system such as that described in GB-B-2332331, an embodiment of which is shown schematically in FIG. 9, the system being adapted for detecting targets in different media, as described above.

FIG. 9 shows a schematic diagram of a sensor 6 without a common path optic operating in a medium 3 (for example crude oil) contained in a tubular structure 1. In this example the radial position of the sensor is controlled by the spider assembly 17. The illuminators 11 which, using the present invention, are as described above, are mounted on the spider assembly, in this case to illuminate the internal walls of the structure, and returning radiation is collected at the sensor window 16.

This system could also be adapted to incorporate the common path optic and/or amplifier features described above.

What is claimed:

1. A down-hole or in-vessel imaging apparatus, comprising illuminating means for emitting radiation of a specified wavelength or waveband through a medium to a target;

detector means for detecting radiation deflected by said target;

a selectable wavelength or waveband system, including different amplifiers for providing different non-linear amplification of different media of output of the detector means; and means for selecting between said amplifiers.

2. The sensor of claim 1, wherein one amplifier is a video amplifier with a non-linear response.

3. The sensor of claim 1, further comprising means for varying a non-linear function of said output.

4. The sensor of claim 3, wherein said means for varying said non-linear function of said output is a remote control means.

5. The sensor of claim 1, further comprising means for automatically controlling illumination power.

6. The sensor of claim 1, wherein said illumination means comprises a single laser diode.

7. The sensor of claim 1, wherein said illumination means comprises an array of laser diodes assembled into a module or modules installed within an image sensor housing.

8. The sensor of claim 7, further comprising separate electrical connections to diodes or groups of diodes emitting at different wavelengths.

9. The sensor of claim 7, wherein said sensor further comprises power conditioning for said laser diode array and detector, an analogue video output, and control electronics to adjust independently the power output of two or more laser diodes or groups of diodes.

10. The sensor of claim 9, wherein said output power control is commanded by signals applied to the video output line, decoded within the image sensor.

11. The sensor of claim 9, wherein signals applied to the video line are used to adjust the characteristics of the non-linear amplifier.

12. The sensor of claim 9, further comprising
internal digitisation and compression of the output signal, and a digital output, with separate command lines.

13. The image sensor of claim 12, wherein
the sensor housing is arranged in a rectangular geometry.

14. The sensor of claim 1, further comprising
stabilising or temperature control means.

15. The sensor of claim 1, wherein
said illumination means are collimated laser beams.

16. The sensor of claim 1, wherein
said illumination means comprises a broad-band source or sources.

17. The sensor of claim 1, wherein
said illumination means comprises more than one independently controllable broad-band source, each with its own wavelength restricting filter or filters.

18. The sensor of claim 1, further comprising
cylindrical spheric or aspheric lenses in front of said illuminating means.

19. The sensor of claim 1, further comprising
a common-path optic which forms an image sensor window,
wherein said common-path optic transmits the outgoing illumination radiation and the returning radiation through the same window area in contact with surrounding media.

20. The sensor of claim 19, wherein
said common-path optic comprises an assembly of more than one component.

21. The sensor of claim 19, wherein
said common-path optic provides optical power to form all or part of the image sensor focussing optics, the illuminator beam shaping optics and to correct distortion in the optical system.

22. The sensor of claim 1, further comprising
a casing;
wherein said illumination means is provided externally to said casing.

23. The image sensor of claim 1, wherein
said image sensor is arranged in a cylindrical geometry with a sideways-looking optical system.

24. The image sensor of claim 23, wherein
said sensor housing has a cylindrical profile and
said side view window is curved to match the cylindrical profile of the sensor housing.

25. The image sensor of claim 1, wherein
the sensor is arranged with the window at the end of the housing.

* * * * *